US006722503B2

(12) United States Patent
Watters et al.

(10) Patent No.: US 6,722,503 B2
(45) Date of Patent: Apr. 20, 2004

(54) INTEGRALLY FORMED SEPARATOR/ SCREEN FEEDBOX ASSEMBLY

(75) Inventors: Larry A. Watters, Washington County, PA (US); Daniel S. Placha, Allegheny County, PA (US)

(73) Assignee: Sedgman, LLC, Pittsburgh, PA (US)

( * ) Notice: Subject to any disclaimer, the term of this patent is extended or adjusted under 35 U.S.C. 154(b) by 149 days.

(21) Appl. No.: 10/096,403

(22) Filed: Mar. 12, 2002

(65) Prior Publication Data

US 2003/0173260 A1 Sep. 18, 2003

(51) Int. Cl.[7] ..... B07C 1/00; B07C 1/30

(52) U.S. Cl. ..... 209/38; 209/39; 209/215; 209/217; 209/225; 209/231

(58) Field of Search ..... 209/12.1, 38, 39, 209/40, 636, 215, 217, 225, 226, 231, 232, 243, 244, 309

(56) References Cited

U.S. PATENT DOCUMENTS 2,607,478 A * 8/1952 Newton ..... 209/39
2,952,361 A * 9/1960 Newton ..... 209/232
3,168,464 A * 2/1965 Ferris et al. ..... 209/223.1
3,595,386 A * 7/1971 Hradel ..... 209/8
3,737,032 A * 6/1973 Burkitt ..... 209/10
4,686,035 A * 8/1987 Estabrook ..... 210/137
4,795,037 A * 1/1989 Rich, Jr. ..... 209/3
4,921,597 A * 5/1990 Lurie ..... 209/223.2
5,377,845 A * 1/1995 Hamen et al. ..... 209/223.2
5,676,710 A * 10/1997 Chedgy ..... 44/621

* cited by examiner

*Primary Examiner*—Donald P. Walsh
*Assistant Examiner*—Jonathan R. Miller
(74) *Attorney, Agent, or Firm*—Buchanan Ingersoll, P.C.

(57) ABSTRACT

In a coal preparation plant which receives a raw coal feed and separates the raw coal feed into a clean coal feed and a refuse feed, an apparatus is provided for receiving and mixing the raw coal feed with water. The inventive apparatus includes a deslime screen assembly including a feedbox, magnetic separator and a deslime screen. The feedbox receives the raw coal feed and directs the raw coal onto the deslime screen for separation into coarse and fine sized raw coal fractions. The magnetic separator is provided which is integrally formed with the feedbox. The magnetic separator receives an input slurry of magnetic solid particles and water from the coal preparation plant, and separates the magnetic solid particles from the input slurry. The overflow tailings slurry output by the magnetic separator from which magnetic solid particles have been removed is received directly by the feedbox and mixed with the raw coal feed particles received thereby.

17 Claims, 2 Drawing Sheets

INTEGRALLY FORMED SEPARATOR/ SCREEN FEEDBOX ASSEMBLY

FIELD OF THE INVENTION

The present invention is directed generally toward coal preparation plants and, more particularly, toward an improved integrally formed magnetic separator and screen feedbox assembly for receiving and mixing with water, raw coal particles received at a coal preparation plant.

BACKGROUND OF THE INVENTION

Coal preparation plants separate organic and non-organic solid particles by their specific gravities. The coal preparation plant receives a feed of raw mined coal and separates the raw mined coal into clean coal and refuse. Coal preparation plants typically utilize two basic processing methods for separating raw coal from rock and varying proportions of striated rock and coal from the higher quality coal. These two processing methods include heavy media and water based separation methods. Heavy media, utilizing a slurry of media, e.g., water and magnetite or ferrosilicon, to separate the coal from the refuse according to their specific gravity of dry solids, is the most common separation process for larger size (Plus 1 mm–0.5 mm) particles. Whereas, water based separation processes are more commonly used for the "cleaning" of the finer sized particles, as that term is commonly understood in the coal preparation art. One type of heavy media circuitry used in the coal preparation plants includes a heavy media cyclone.

Coal preparation plants using heavy media cyclones operate with three separate types of screens for coal processing, namely, a deslime screen, a refuse screen and a clean coal screen. A common screening assembly used in many coal preparation plants today known as a vibratory banana screen. The deslime screen receives the raw coal feed particles and separates them into coarse and fine sized fractions. The coarse or larger sized particles discharged from the deslime screen surface are directed to the heavy media separation section of the coal preparation plant, while the finer sized particles passing through the deslime screen are directed toward the water based separation section of the coal preparation plant.

The clean coal and refuse screens receive the clean coal and refuse particles, respectively produced by the heavy media separating section. While on the clean coal and refuse screens, the clean coal and refuse particles are rinsed with water, and the finer particles and water passing through the respective screens are recirculated through the coal preparation plant. Rinsing the clean coal and refuse particles is primarily done to recover the particles of media, such as magnetite, remaining thereon as a result of the coal/refuse separation process, as magnetite can be quite expensive.

Typically, the slurry of magnetite and water recovered by the underpans of the clean coal and refuse screens are either pumped or gravity fed to a magnetic separator for magnetite recovery. The slurry of magnetite and water is passed through the magnetic separator which recovers the magnetite from the slurry and returns the magnetite to the heavy media processing section of the coal preparation plant. The remaining water from which the magnetite has been removed, often called tailings water, is discharged by the magnetic separator and reused as process water by the coal preparation plant.

SUMMARY OF THE INVENTION

In a coal preparation plant which receives a raw coal feed and separates the raw coal feed into a clean coal and a refuse, an apparatus is provided for use therein. The inventive apparatus receives and mixes the raw coal feed with water. A feedbox receives the raw coal feed and directs the raw coal onto a deslime screen for separation into coarse and fine sized raw coal fractions. A magnetic separator, and specifically the magnetic separator tank, is provided which is integrally formed with the feedbox. The magnetic separator receives an input slurry of magnetic solid particles and water from the coal preparation plant, and separates the magnetic solid particles from the input slurry. The overflow tailings slurry output by the magnetic separator from which magnetic solid particles have been removed is received directly by the feedbox and mixed with the raw coal feed particles received thereby.

In one form, the overflow tailings water output by the magnetic separator is received by the feedbox across an entire width thereof.

The magnetic separator typically includes a feed chamber receiving the input slurry of magnetic solid particles and water and an outlet discharging the overflow tailings slurry. In another form of the present invention, the overflow tailings outlet is integrally formed with the feedbox such that the overflow tailings slurry output thereby is received directly by the feedbox and mixed with the raw coal feed received by the feedbox. In a preferred form, the overflow tailings outlet includes an overflow weir extending the full width of the feedbox.

The magnetic separator also typically includes an underflow tailings outlet formed in the bottom surface thereof for discharging an underflow tailings slurry. Typically, the misplaced coarser sized material settling on the bottom surface of the magnetic separator is included in the underflow tailings slurry and is output at the underflow tailings outlet directly onto the deslime screen or piped to a separate location.

The magnetic separator may include a counter current rotating drum type magnetic separator having a bottom surface and end walls defining a chamber for retaining the input slurry of magnetic solid particles and water. A rotatable drum is provided having a cylindrical wall with a portion positioned beneath a surface of the slurry retained in the process chamber and a magnet positioned within the rotatable drum in proximity to the cylindrical wall and extending around at least the portion of the cylindrical wall beneath the slurry surface. The slurry inlet is positioned on a first side of the bottom surface for feeding the input slurry of magnetic solid particles and water to the process chamber. The concentrated magnetic solid particle outlet is positioned on the first side of the bottom surface for outputting the separated magnetic solid particles. The overflow weir, is positioned on a second side of the bottom surface opposite the first side and outputs the overflow tailings slurry from which magnetic solid particles have been removed via magnetic attraction to the drum. The overflow tailings slurry is received directly by the feedbox mixing with the raw coal feed received therein.

In a further form, the feedbox further includes a coal retention area "drop box" where the raw coal feed received by the feedbox is mixed with the overflow tailings slurry output at the overflow weir.

A method according to the present invention is also provided for mixing a raw coal feed received at a coal preparation plant with water. The inventive method generally includes the steps of receiving a raw coal feed at a feedbox of a receiving assembly in the coal preparation plant, providing a magnetic separator integrally formed with the feedbox of the receiving assembly, and using an overflow tailings slurry output by the magnetic separator directly to the feedbox to mix with the raw coal feed received at the feedbox.

In one form of the inventive method, the magnetic separator includes an overflow weir outputting the overflow tailings slurry. The overflow weir is integrally formed with the feedbox such that the overflow tailings slurry output at the overflow weir consists of a wall of water which mixes with the raw coal feed received by the feedbox.

It is the object of the present invention to:

improve the mixing of a raw coal feed received at a coal preparation plant with water;

provide an apparatus for use in coal preparation plants occupying minimal space; and more efficiently operate a coal preparation plant.

Other objects, aspects and advantages of the present invention can be obtained from a study of the specification, the drawings, the appended claims.

DETAILED DESCRIPTION OF THE INVENTION

Figure 1:
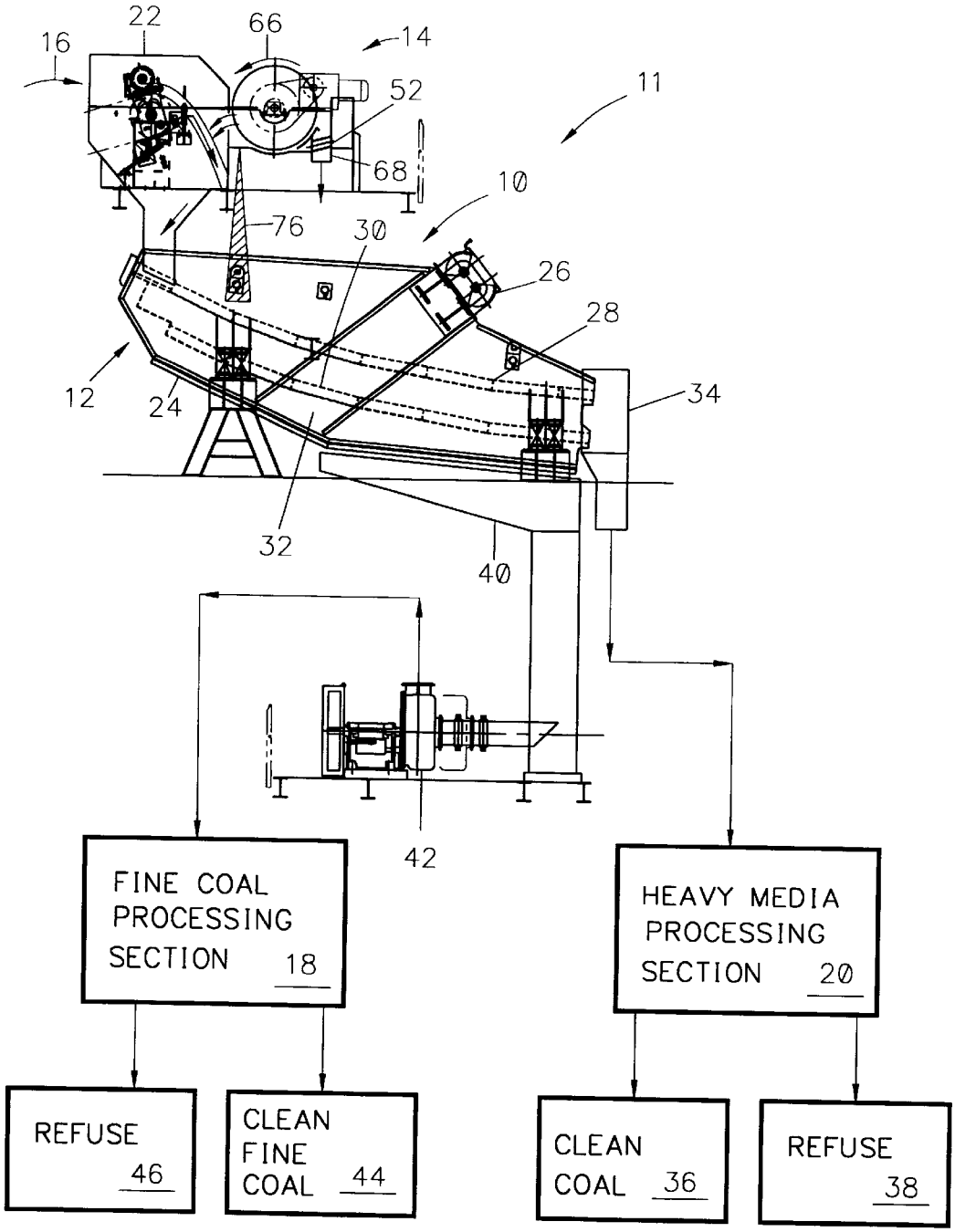
FIG. 1 is a side view of an integrally formed magnetic separator/screen feedbox assembly according to the present invention.

Referring to FIG. 1, the inventive integrally formed magnetic separator/screen feedbox assembly is shown generally at 10 for use in coal preparation plants, shown generally at 11. The inventive separator/screen feedbox assembly 10 generally includes a deslime screen assembly 12 and a magnetic separator 14 associated with the deslime screen assembly 12. The deslime screen assembly 12 receives a raw coal 16 and conventionally separates the raw coal 16 into fine and coarse raw coal size fractions for processing by fine coal 18 and heavy media 20 processing sections of the coal preparation plant 11.

The deslime screen assembly 12 includes a feedbox 22 and a deslime screen 24. As shown in FIG. 1, the deslime screen 24 preferably includes a multislope "banana" screen vibrated by a conventional vibrating device 26. However, other screen types may be utilized for the deslime screen 24 without departing from the spirit and scope of the present invention. The feedbox 22 receives the raw coal feed 16 and directs the raw coal feed 16 onto the deslime screen 24 for separation into coarse and fine sized raw coal fractions.

The deslime screen 24 includes top 28 and bottom 30 deck screens and an underpan 32 located below the top 28 and bottom 30 deck screens. As the raw coal feed 16 is moved over the length of the deslime screen 24, the top 28 and bottom 30 deck screens separate the larger raw coal feed particles from the smaller and finer particles which pass through the screens 28 and 30 into the underpan 32. The raw coal feed particles 16 screened by the top 28 and bottom 30 deck screens are passed to the heavy media processing section 20 of the coal preparation plant via chutework 34. The heavy media processing section 20 utilizes conventional coal processing techniques, typically utilizing a magnetic material such as magnetite as a separation medium, to produce clean coal 36 and refuse 38. These clean coal 36 and refuse 38 are directed to appropriate sections of the coal preparation plant 11 for further conventional processing. The finer raw coal particles 16 and water passing to the underpan 32 are fed to the fine processing section 18 of the coal preparation plant 11, via chutework 40 and pump 42 or other conventional means. The fine coal processing section 18 utilizes conventional coal processing techniques, typically using water based separation methods, to develop clean fine coal 44 and refuse 46 feeds, which are conventionally further processed.

In order to obtain maximum screening efficiencies of the raw coal 16 on the deslime screen 24, an adequate quantity of water equally distributed across the feedbox is required to pre-wet the raw coal 16 as it is fed onto the deslime screen 24. In order to provide maximum efficiency in the coal preparation plant 11, the present invention integrates the magnetic separator 14 with the feedbox 22 of the deslime screen assembly 12 and utilizes the tailings from the magnetic separator 14 to properly pre-wet the raw coal 16.

Figure 2:
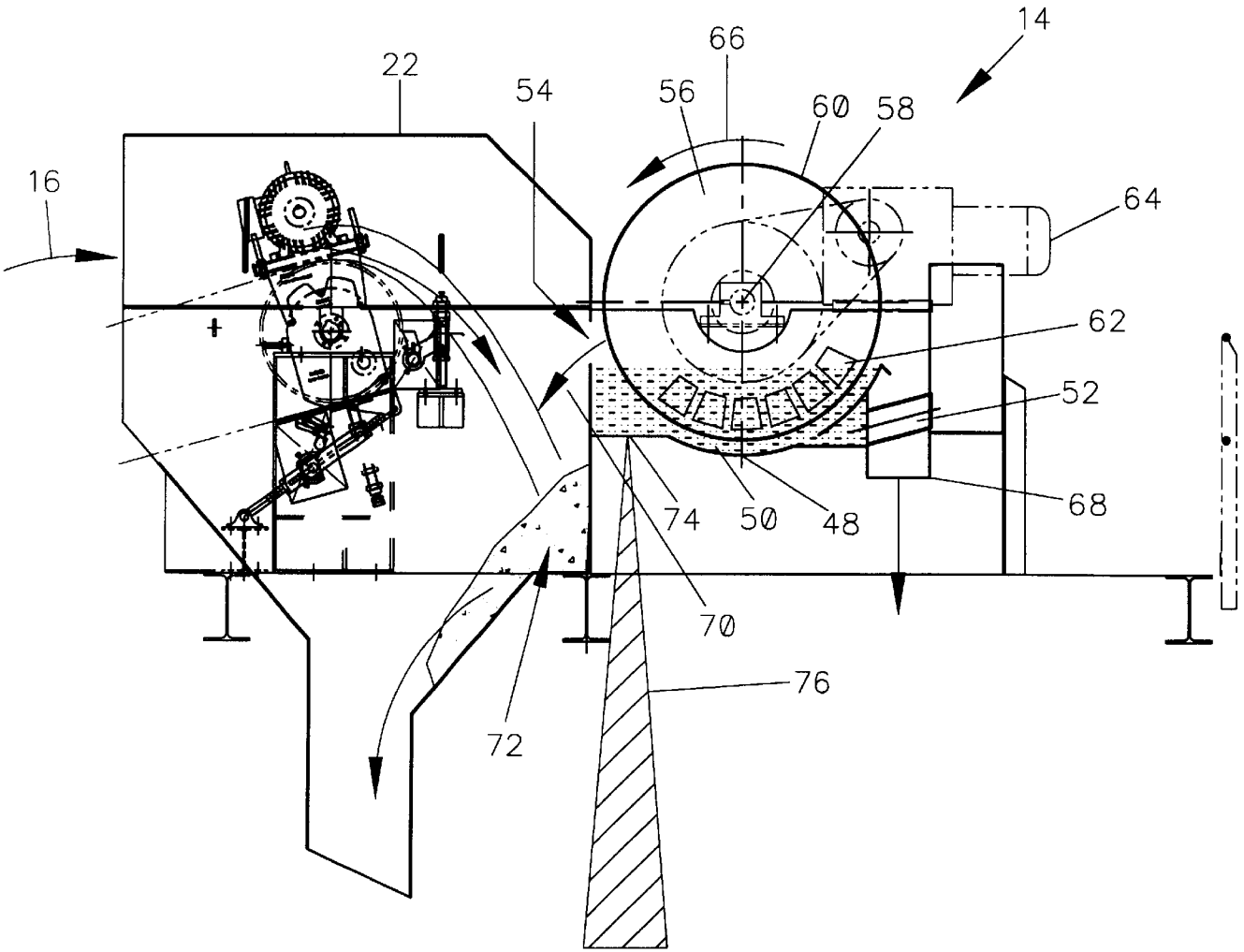
FIG. 2 is an enlarged view of the integrally formed magnetic separator shown in FIG. 1.

As shown more clearly in FIG. 2, the magnetic separator 14 is integrally formed with the feedbox 22 of the deslime screen assembly 12. Magnetite is typically utilized as the media by the heavy media processing 20 for separating the clean coal 36 from the refuse 38. Since magnetite is generally expensive, recovering it is of particular importance in coal preparation plants. The magnetic separator 14 recovers the magnetite, taking advantage of its magnetic properties, and returns the recovered magnetite to the heavy media processing section 20 of the coal preparation plant 11.

The magnetic separator 14 includes a bottom surface 48 and an end walls defining a retaining chamber 50. A slurry inlet pipe 52 is provided on one side of the bottom surface 48 for feeding an input slurry of magnetic solid particles, e.g., magnetite and water, to the chamber 50. On the other side of the bottom surface 48 an overflow weir 54 is provided which is integrally formed with the feedbox 22.

A rotating drum 56 is mounted within the chamber 50 on a horizontal axis 58. The drum 56 includes a cylindrical wall 60 and end walls, with a portion of the cylindrical wall positioned beneath a surface of the input slurry retained in the chamber 50. A magnet 62 is positioned within the drum 56 in proximity to the cylindrical wall 60 and extends at an arc around at least the portion of the cylindrical wall 60 beneath the input slurry surface.

The drum 56 is driven by a motor 64 in a conventional manner and rotates in a direction shown by the arrow 66. As the drum 56 rotates, the magnetic particles in the slurry within the chamber 50 are attracted to the surface of the cylindrical wall 60. As the drum 56 rotates further, the magnetic particles are carried up to a space past the end of the internal magnet 62. As the magnetic field of the magnet 62 is reduced, the magnetic particles fall off and are received in a magnetic particle discharge chute 68 positioned on the same side of the separator as the slurry input feed 52. The recovered magnetic particles in the discharge chute 68 are directed back to the heavy media processing section 20 of the coal preparation plant 11.

This particular type of magnetic separator 14 is known as a counter-current rotational drum type magnetic separator, as the drum 56 rotates in a direction opposite to the input slurry flow. However, concurrent rotational drum type magnetic separators, in which the drum rotates in the same direction as the input slurry flow, may easily be implemented without departing from the spirit and scope of the present invention.

The magnetic separator also outputs an overflow tailings slurry 70 flowing over the overflow weir 54. The overflow tailings slurry 70 has a low content of magnetic particles in it, as the majority of the magnetic particles will have been removed by the rotating drum 56. Any magnetic particles in the overflow tailings slurry 70 will consist of only very fine materials. Since the overflow weir 54 is integrally formed with the feedbox 22, the overflow tailings slurry 70 flowing over the overflow weir 54 flows directly into the feedbox 22, forming essentially a wall of water, preferably across an entire width of the feedbox 22. As the raw coal feed 16 is received at the feedbox 22, it is directed to the wall of overflow tailings slurry 70, such that the wall of overflow tailings slurry 70 is mixed with the raw coal feed particles 16 as they are received in the feedbox 22 of the coal preparation plant 11.

More particularly, the feedbox 22 includes a coal retention area, or "deadbox", 72 where the raw coal feed 16 received by the feedbox 22 is mixed with the overflow weir tailings slurry 54 of the magnetic separator.

Additionally, the bottom surface 48 of the magnetic separator 14 includes a manually adjustable underflow orifice 74. This orifice 74 allows an underflow tailings slurry 76 to be discharged from the chamber 50. Typically, coarse particles settling on the bottom surface 48 of the magnetic separator 14 are included in the underflow tailings slurry 76, and may be discharged from the chamber 50 simply by opening the orifice 74. The orifice 74 is positioned such that the underflow tailings slurry 76 is output directly onto the deslime screen 24, as shown more particularly in FIG. 1.

By utilizing the overflow tailings slurry 70 from the magnetic separator 14 to mix with the raw coal feed particles 16, the cost of the equipment in the coal preparation plant 11 is reduced, as is the size of the coal preparation plant 11.

While the present invention has been described with particular reference the drawings, it should be understood that various modifications could be made without departing from the spirit and scope of the present invention. For instance, while a rotating drum type magnetic separator has been described herein, other types of magnetic separators may be implemented without departing from the spirit and scope of the present invention. Further, while the screen assembly has been described as including a "banana" screen, other types of screen assemblies may be also be implemented, without departing from the spirit and scope of the present invention. Still further, while the inventive separator/screen feedbox assembly 10 has been described herein as used in a coal preparation plant 11, the inventive separator/screen feedbox assembly 10 may be utilized in preparation plants for ore and minerals other than coal, using separation media other than magnetite, without departing from the spirit and scope of the present invention.

We claim:

1. In a mineral preparation plant receiving a raw mineral feed and separating the raw mineral feed into clean mineral and refuse using a media based separation process, an apparatus for receiving and mixing the raw mineral feed with water, said apparatus comprising:

a deslime screen assembly receiving the raw mineral feed and separating the raw mineral into coarse and fine sized fractions, the deslime screen assembly including a feedbox and a deslime screen, wherein the feedbox receives the raw mineral feed and directs the raw mineral feed onto the deslime screen for separation; and a media separating device integrally formed with the feedbox, the media separating device receiving an input slurry of media and water from the mineral preparation plant and separating the input slurry into particles of media and a overflow tailings water slurry from which particles of media have been removed, wherein the overflow tailings water slurry from the media separating device is received directly by the feedbox such that the overflow tailings water slurry mixes with the raw mineral feed received by the feedbox.

2. The apparatus of claim 1, wherein the media separating device includes an inlet receiving the input slurry of media and water and a first outlet outputting the overflow tailings water slurry, wherein the first outlet is integrally formed with the feedbox such that the overflow tailings water slurry output at the first outlet is received directly by the feedbox to mix with the raw mineral feed received by the feedbox.

3. The apparatus of claim 2, wherein the first outlet comprises an overflow weir.

4. The apparatus of claim 2, wherein the media separating device includes a second outlet formed in a bottom surface thereof for discharging an underflow tailings water slurry directly onto the deslime screen, wherein the underflow tailings water slurry including coarse material present in the input slurry settling on the bottom surface of the media separating device.

5. The apparatus of claim 1, wherein the mineral comprises coal, wherein the media comprises magnetite, and wherein the media separating device comprises a magnetic separator.

6. The apparatus of claim 5, wherein the magnetic separator comprises a rotating drum type magnetic separator.

7. The apparatus of claim 6, wherein the rotating drum type magnetic separator includes a bottom surface and end walls defining a chamber for retaining the input slurry of magnetite and water, a rotatable drum having a cylindrical wall with a portion of the cylindrical wall positioned beneath a surface of the slurry retained in the chamber and a magnet positioned within the rotatable drum in proximity to the cylindrical wall and extending around at least the portion of the cylindrical wall beneath the input slurry surface, a slurry inlet on a first side of the bottom surface for feeding the input slurry of magnetite and water to the chamber, a solid magnetite particle outlet on the first side of the bottom surface for outputting the separated solid magnetite particles, and the first outlet formed on a second side of the bottom surface opposite the first side outputting the overflow tailings water slurry from which solid magnetite particles have been removed via magnetic attraction to the drum, wherein the overflow tailings water slurry output at the first outlet is received directly by the feedbox mixing with the raw mineral feed received by the feedbox.

8. The apparatus of claim 1, wherein the feedbox includes a mineral retention area where the raw mineral feed received by the feedbox is retained for a period of time prior to being directed by the feedbox to the deslime screen, and wherein the overflow tailings water slurry output at the first outlet mixes with the raw material feed during the period of time it is retained in the mineral retention area.

9. The apparatus of claim 3, wherein the overflow tailings water slurry output at the overflow weir comprises a wall of water slurry flowing over the overflow weir.

10. The apparatus of claim 9, wherein the overflow weir is integrally formed with the feedbox such that the wall of water slurry flowing over the overflow weir is formed over substantially an entire width of the feedbox to mix with the raw mineral feed received by the feedbox.

11. A method of mixing a raw mineral feed received at a mineral preparation plant with water, said method comprising the steps of:

receiving a raw mineral feed at a deslime screen assembly in the mineral preparation plant, the deslime screen assembly comprising a feedbox and a deslime screen, the feedbox receiving the raw mineral feed and directing the raw mineral feed onto the deslime screen for separation into coarse and fine sized fractions;

providing a media separating device having an overflow weir integrally formed with the feedbox, the media separating device receiving an input slurry of media particles and water, removing the media particles from the input slurry, and outputting at the overflow weir an overflow tailings water slurry having media solid particles removed therefrom; and receiving the overflow tailings water slurry directly at the feedbox and mixing the overflow tailings water slurry with the raw mineral feed at the feedbox.

12. The method of claim 11, wherein the feedbox includes a mineral retention area where the raw mineral feed received by the feedbox is retained for a period of time prior to being directed by the feedbox to the deslime screen, and wherein the overflow tailings water slurry output at the overflow weir mixes with the raw mineral feed during the period of time it is retained in the mineral retention area.

13. The method of claim 11, wherein the mineral comprises coal, wherein the media comprises magnetite, and wherein the media separating device comprises a magnetic separator.

14. The method of claim 13, wherein the magnetic separator comprises a rotating drum type magnetic separator.

15. The method of claim 11, further comprising the step of outputting at the media separating device an underflow tailings water slurry directly onto the deslime screen, wherein the underflow tailings water slurry includes coarse material present in the input slurry settling on a bottom surface of the media separating device.

16. The method of claim 11, wherein the overflow tailings water slurry output at the overflow weir comprises a wall of water slurry flowing over the overflow weir.

17. The method of claim 16, wherein the overflow weir is integrally formed with the feedbox such that the wall of water slurry flowing over the overflow weir is formed over substantially an entire width of the feedbox to mix with the raw mineral feed received by the feedbox.

* * * * *